US008550412B2

(12) United States Patent
Slade et al.

(10) Patent No.: US 8,550,412 B2
(45) Date of Patent: Oct. 8, 2013

(54) HIGH LOAD RESISTANT STOP LAMP SWITCH BRACKETS AND BRAKE PEDAL ASSEMBLIES INCORPORATING THE SAME

(75) Inventors: Scott Richard Slade, Livonia, MI (US); Crystal Jasmine Mink, South Lyon, MI (US); Herb Meingast, Ann Arbor, MI (US)

(73) Assignee: Toyota Motor Engineering and Manufacturing North America, Inc., Erlanger, KY (US)

( * ) Notice: Subject to any disclaimer, the term of this patent is extended or adjusted under 35 U.S.C. 154(b) by 161 days.

(21) Appl. No.: 12/975,935

(22) Filed: Dec. 22, 2010

(65) Prior Publication Data

US 2012/0111138 A1 May 10, 2012

Related U.S. Application Data

(60) Provisional application No. 61/411,097, filed on Nov. 8, 2010.

(51) Int. Cl.

| | |
|---|---|
| ***H01H 3/14*** | (2006.01) |
| ***H01H 9/00*** | (2006.01) |
| ***H01H 13/00*** | (2006.01) |
| ***G05G 1/30*** | (2008.04) |
| ***A47B 96/06*** | (2006.01) |

(52) U.S. Cl.

USPC ..... 248/220.21; 200/61.89; 200/295; 74/512; 74/560; 180/90.6

(58) Field of Classification Search

USPC ..... 248/220.21, 220.1; 200/61.89, 295; 74/512, 560; 180/90.6

See application file for complete search history.

(56) References Cited

U.S. PATENT DOCUMENTS

| | | | | |
|---|---|---|---|---|
| 3,115,559 | A | 12/1963 | Cass et al. | |
| 4,297,550 | A * | 10/1981 | Leighton | 200/61.89 |
| 4,819,500 | A * | 4/1989 | Musumiya et al. | 74/513 |
| 5,211,072 | A * | 5/1993 | Barlas et al. | 74/512 |
| 5,416,295 | A * | 5/1995 | White et al. | 200/86.5 |
| 5,889,246 | A * | 3/1999 | Frank et al. | 200/61.89 |
| 5,996,440 | A * | 12/1999 | Nawata et al. | 74/512 |
| 6,653,582 | B2 | 11/2003 | Kasakawa et al. | |
| 6,701,800 | B2 * | 3/2004 | Saitou et al. | 74/512 |
| 6,919,520 | B2 * | 7/2005 | Kasakawa et al. | 200/61.89 |
| 7,011,339 | B2 * | 3/2006 | Oono et al. | 280/748 |
| 7,398,708 | B2 * | 7/2008 | Harashima et al. | 74/512 |
| 7,665,387 | B2 * | 2/2010 | Park | 74/512 |
| 7,850,023 | B2 * | 12/2010 | Silveria | 211/194 |
| 7,928,332 | B2 * | 4/2011 | Kim et al. | 200/61.89 |
| 2002/0043125 | A1 * | 4/2002 | Oono et al. | 74/512 |
| 2007/0137915 | A1 * | 6/2007 | Sanagi et al. | 180/232 |
| 2009/0152080 | A1 * | 6/2009 | Kim et al. | 200/61.89 |
| 2010/0107804 | A1 * | 5/2010 | Tervol et al. | 74/512 |
| 2012/0111138 | A1 * | 5/2012 | Slade et al. | 74/512 |
| 2012/0138435 | A1 * | 6/2012 | Lee et al. | 200/61.89 |

FOREIGN PATENT DOCUMENTS

| | | |
|---|---|---|
| EP | 1577184 | 9/2005 |
| EP | 1864877 | 12/2007 |

* cited by examiner

*Primary Examiner* — Terrell McKinnon
*Assistant Examiner* — Christopher Garft
(74) *Attorney, Agent, or Firm* — Dinsmore & Shohl LLP

(57) ABSTRACT

A switch bracket includes a bracket body that includes a lower surface and a kickplate. The switch bracket also includes a switch mount located on the lower surface of the bracket body, where at least a portion of the kickplate extends outward from the lower surface further than the stop lamp switch that is retained at the switch mount. In another embodiment, a brake pedal assembly includes a switch bracket coupled to a pedal mount, the switch bracket having a lower surface and a kickplate. The brake pedal assembly also includes a stop lamp switch coupled to the lower surface of the switch bracket, and a brake pedal rotationally engaged with the pedal mount and coupled to the stop lamp switch.

8 Claims, 5 Drawing Sheets

HIGH LOAD RESISTANT STOP LAMP SWITCH BRACKETS AND BRAKE PEDAL ASSEMBLIES INCORPORATING THE SAME

RELATED APPLICATIONS

This application claims the benefit of the filing date of U.S. Provisional Application Ser. No. 61/411,097 filed Nov. 8, 2010, the entire disclosure of which is hereby incorporated by reference.

TECHNICAL FIELD

The present specification generally relates to pedal assemblies for motor vehicles and, more specifically, to pedal assemblies including high load resistant stop lamp switch brackets.

BACKGROUND

In motor vehicles, there may be a desire to place a stop lamp switch in location close to the brake pedals of the motor vehicle. The stop lamp switch controls the actuation of the brake lights located at the rear of motor vehicle. When the driver of the motor vehicle depresses the brake pedal, the brakes, along with the stop lamp switch, are actuated.

In certain motor vehicles, the footspace of the passenger cabin, or the area in which the brake pedal assembly is located, may be limited. In these instances, the stop lamp switch may be placed in locations in the footspace area of the motor vehicle that are accessible by the feet of the driver. Contact between the feet of the driver and the stop lamp switch may lead to the stop lamp switch becoming inoperable. Accordingly, a need exists for high-load resistant stop lamp switch brackets.

SUMMARY

In one embodiment, a switch bracket includes a bracket body having a lower surface and a kickplate. The switch bracket also includes a switch mount located on the lower surface of the bracket body, where the switch mount is configured to retain a stop lamp switch, and at least a portion of the kickplate extends outward from the lower surface further than the stop lamp switch that is retained at the switch mount.

In another embodiment, a brake pedal assembly includes a switch bracket coupled to a pedal mount, the switch bracket having a lower surface and a kickplate. The brake pedal assembly also includes a stop lamp switch coupled to the lower surface of the switch bracket, and a brake pedal rotationally engaged with the pedal mount and coupled to the stop lamp switch.

In yet another embodiment, a motor vehicle includes a pedal mount, a brake pedal rotationally engaged with the pedal mount, and a switch bracket coupled to the pedal mount, the switch bracket having a lower surface and a kickplate. The motor vehicle also includes a stop lamp switch coupled to the brake pedal and to the switch bracket, and one or more brake lights electrically connected to the stop lamp switch.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments of the present disclosure generally relate to brake pedal high load resistant stop lamp switch brackets that may be used in conjunction with pedal assemblies for motor vehicles. The switch bracket may provide support to a stop lamp switch such that when a driver depresses the brake pedal with his or her foot, the stop lamp switch remains in a fixed position so that the brake pedal can actuate the stop lamp switch. Because the pedal assemblies are located in the footspace areas of the motor vehicle, the switch bracket may be prone to inadvertent contact with the foot of the driver.

The stop lamp switch bracket may resist loads applied to the switch bracket through incidental contact with the foot of the driver, or through a direct application of force by the foot of the driver. The switch bracket provides protection to the stop lamp switch to minimize the likelihood that the foot of the driver inadvertently contact the stop lamp switch. Additionally, direct application of force may be high, for example, if applied by a driver during an emergency stop. The switch bracket includes features that reinforce the switch bracket against these ergonomic loading conditions and/or deflect the force to control and direct the force that can be transferred to the switch bracket.

Figure 2:
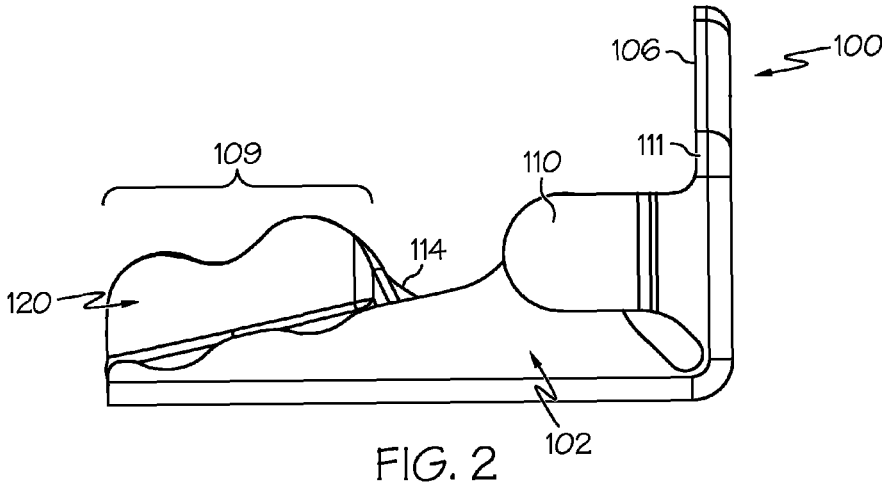
FIG. 2 depicts a front view of a stop lamp switch bracket according to one or more embodiments shown and described herein.
Figure 3:
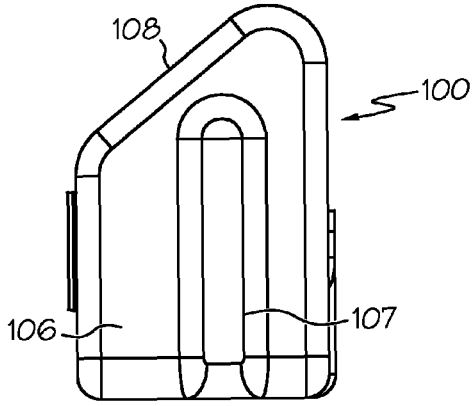
FIG. 3 depicts a side view of a stop lamp switch bracket according to one or more embodiments shown and described herein.
Figure 4:
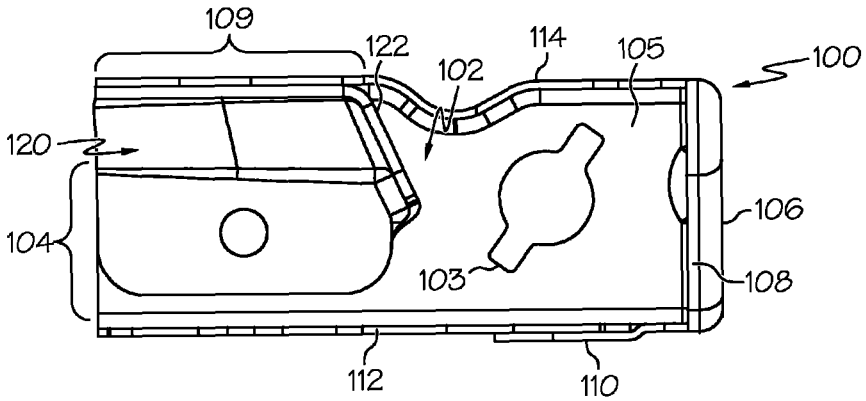
FIG. 4 depicts a top view of a stop lamp switch bracket according to one or more embodiments shown and described herein.

Referring now to FIGS. 1-4 in detail, the switch bracket 100 includes a bracket body 102 and may include a gusset bracket 120. The bracket body 102 includes a kickplate 106 and lower surface 104. The kickplate 106 provides a protective region 105 within the bracket body 102 in the area between the kickplate 106 and the lower surface 104. As depicted in FIG. 4, the illustrated bracket body 102 further includes a switch mount 103 in the lower surface 104. The switch mount 103 is an aperture in the bracket body 102. A stop lamp switch can be inserted through the switch mount 103 and restrained in place. The switch mount 103 is not limited to the shape as illustrated in FIG. 4, and may be any shape that corresponds with a desired switch.

Figure 1:
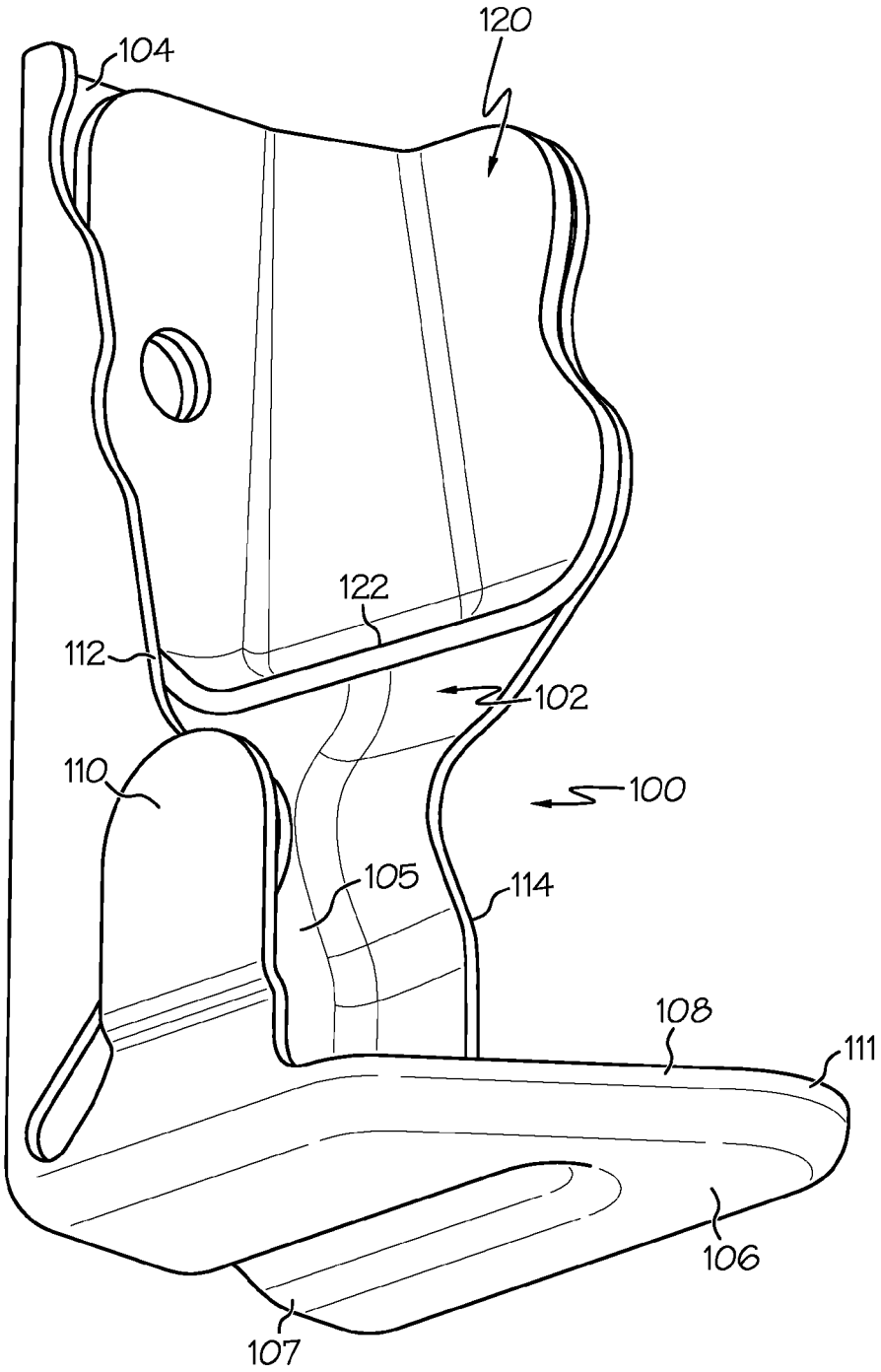
FIG. 1 depicts a perspective view of a stop lamp switch bracket according to one or more embodiments shown and described herein.

The embodiment of the switch bracket 100 depicted in FIGS. 1-4 includes features on the kickplate 106 that may increase the strength of the switch bracket 100 and the kickplate 106 itself. The kickplate 106 itself may have a top surface 108 that is angled relative to the lower surface 104. In this embodiment, the top surface 108 is angled about 40° from parallel with the lower surface 104 (see FIG. 3). The angle of the top surface 108 may prevent a force from being directly applied to the switch bracket 100. The kickplate 106 may also include a bead 107 that is formed in the face of the kickplate 106 that provides additional structural support to the kickplate 106. As depicted in FIGS. 1 and 3, the bead 107 extends along a portion of the kickplate 106 in a direction that is approximately perpendicular to the lower surface 104 of the bracket body 102. Additionally, as depicted in FIGS. 1 and 2, the kickplate 106 may have an eased edge 111 (i.e., an edge drawn generally perpendicular to the kickplate 106) along the periphery of the kickplate 106 which may further increase the rigidity of the kickplate 106 itself. The addition of the bead 107 and the eased edge 111 may increase the section modulus, or the ratio of the second moment of area of the cross section to the maximum distance from the neutral axis. An increase in the section modulus of the kickplate 106 corresponds with an increase in the strength of the kickplate 106. As depicted in FIGS. 1-4, the kickplate 106 may be integral to the lower surface of the bracket body 102.

The bracket body 102 may also include a first side flange 112 and a second side flange 114 that run along at least a portion of the sides of the lower surface 104. The first side flange 112 and the second side flange 114 provide additional shielding around the protection region 105 of the bracket body 102. As depicted in FIGS. 1 and 4, the bracket body 102 may include a tab 110 that extends from the kickplate 106. The tab 110 overlaps a portion of the first side flange 112 such the tab 110 can be joined with the first side flange 112, thereby coupling the kickplate 106 with the first side flange 112. In other embodiments, a tab may overlap a portion of the second side flange 114. By coupling the kickplate 106 to at least one of the first side flange 112 or the second side flange 114, the structural rigidity of the bracket body 102 may be increased. As depicted in FIGS. 1-4, the first side flange 112 and the second side flange 114 may be integral to the lower surface 104 of the bracket body 102.

As stated above, the switch bracket 100 may include a gusset bracket 120 that provides additional support to the bracket body 102. The gusset bracket 120 is coupled to the lower surface 104 of the bracket body 102 and to one of the first side flange 112 or the second side flange 114. As depicted in FIGS. 1-4, the gusset bracket 120 is coupled to the second side flange 114. The gusset bracket 120 may include a reinforcement zone 122, which is a portion of the gusset bracket 120 that limits flexing of the gusset bracket 120 by absorbing load in tension. As depicted in FIGS. 1 and 4, the reinforcement zone 122 is generally perpendicular to the lower surface 104 of the bracket body 102. The reinforcement zone 122 may be integral to the gusset bracket 120. The reinforcement zone 122 may provide additional structural rigidity and strength to the switch bracket 100 so that the switch bracket 100 can resist bending, twisting, and/or breaking from a load applied along any area of the switch bracket 100.

One of the first side flange 112 or the second side flange 114 includes an attachment zone 109. In the embodiment depicted in FIGS. 1-4, the second side flange 114 includes the attachment zone 109. The switch bracket 100 is mounted to a brake pedal assembly through the attachment zone 109. If a gusset bracket 120 is included in the switch bracket 100, the gusset bracket 120 is affixed to the same side flange where the attachment zone 109 is included. In the embodiment depicted in FIGS. 1-4, the gusset bracket 120 and the attachment zone 109 are both located on the second side flange 114. In this manner, the gusset bracket 120 provides additional support to the switch bracket 100 that is cantilevered from the attachment zone 109.

Figure 5:
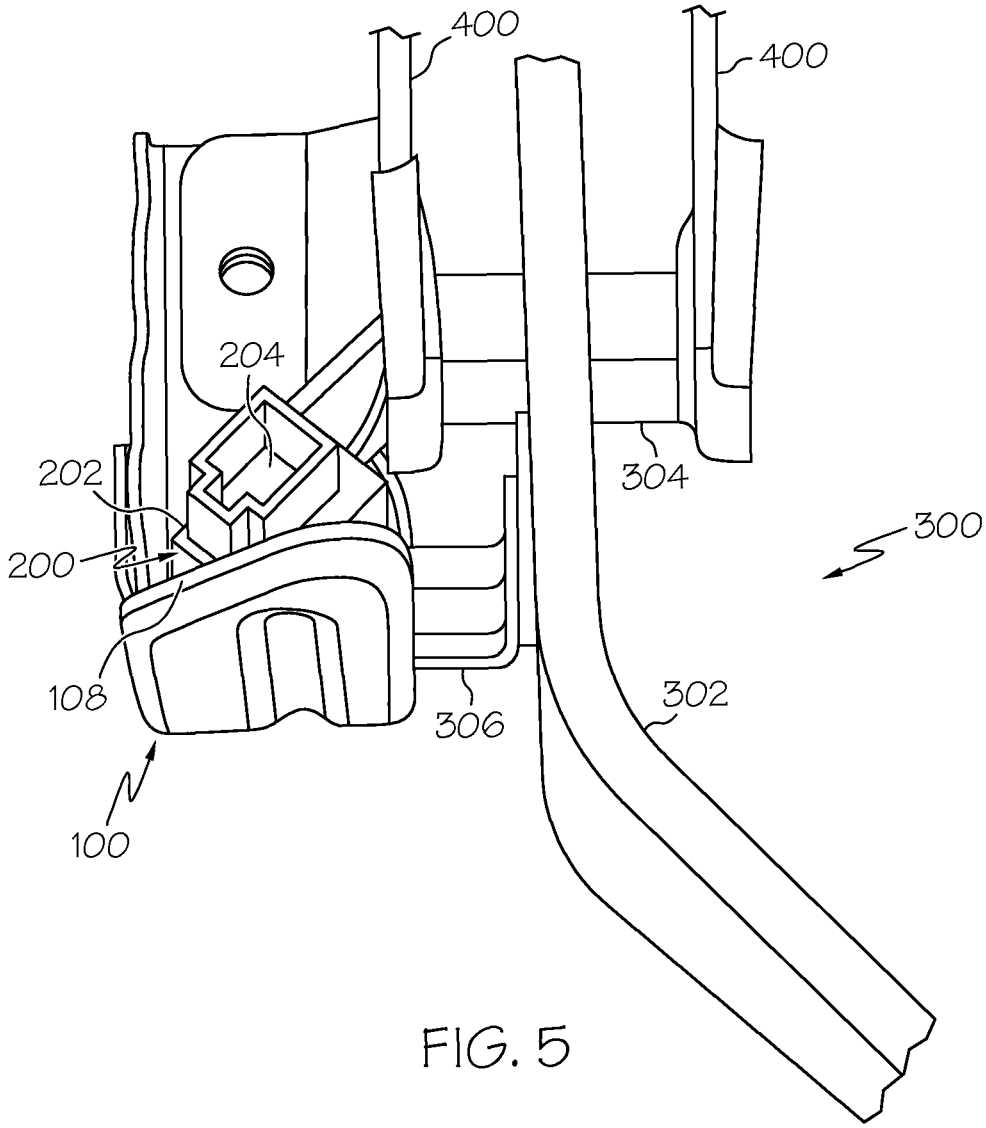
FIG. 5 depicts a perspective view of a pedal assembly that includes a stop lamp switch bracket according to one or more embodiments shown and described herein.
Figure 6:
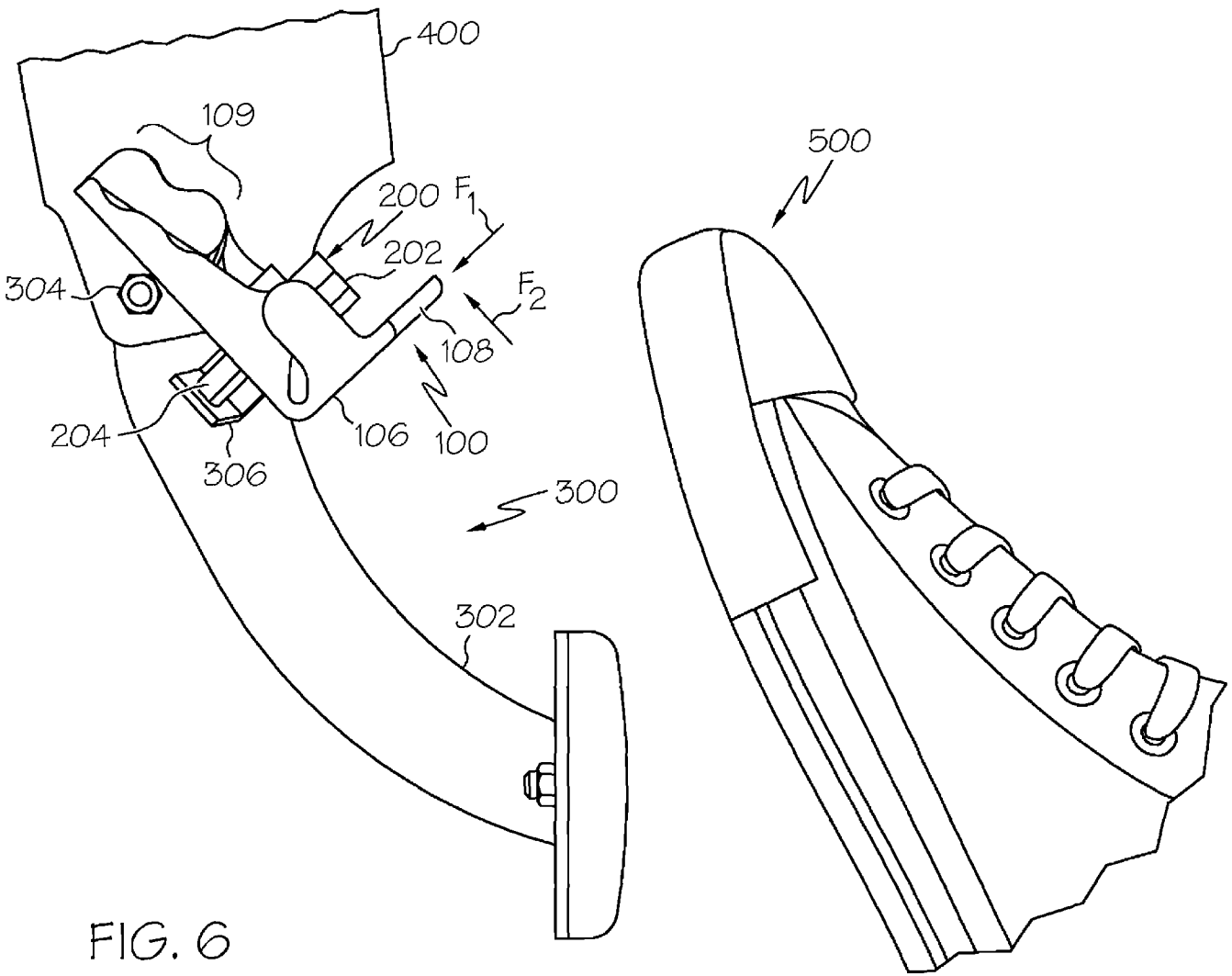
FIG. 6 depicts a perspective view of a pedal assembly that includes a stop lamp switch bracket according to one or more embodiments shown and described herein.

As depicted in FIGS. 5 and 6, the switch bracket 100 may be coupled to a brake pedal assembly 300. The switch bracket 100 illustrated in FIGS. 5 and 6 is coupled to a brake pedal mount 400, such that the attachment zone 109 of the switch bracket 100 is affixed to the brake pedal mount 400 (see FIG. 6). A brake pedal assembly 300 may include a brake pedal 302 that is rotationally engaged with the pedal mounts 400 through a brake pedal pivot 304. The brake pedal assembly 300 may further include an actuation tab 306 that is coupled to the brake pedal 302. When the brake pedal 302 is depressed, both the brake pedal 302 and the actuation tab 306 rotate about the brake pedal pivot 304.

A stop lamp switch 200 may be installed into the switch bracket 100. The stop lamp switch 200 includes a stop lamp switch body 202 and a stop lamp switch slide 204 that traverses through the stop lamp switch body 202. The stop lamp switch body 202 is inserted into and retained by the switch mount 103 of the switch bracket 100, thereby securing the stop lamp switch 200 to the switch bracket 100 and the brake pedal assembly 300. Once the stop lamp switch 200 is installed in the switch bracket 100, the stop lamp switch slide 204 is coupled with the actuation tab 306 of the brake pedal 302. When the brake pedal 302 is depressed by a foot of the driver and moved into an actuated state, the stop lamp switch slide 204 extends along the stop lamp switch body 202. When the driver releases pressure from the brake pedal 302, the brake pedal 302 returns to its resting position, which corresponds with its non-actuated state, the stop lamp switch slide 204 is retracted into the stop lamp switch body 202. The kickplate 106 of the switch bracket 100 may have a size and a shape such that at least a portion of the kickplate 106 extends outward from the lower surface 104 further than the stop lamp switch 200. Such a kickplate 106 and a stop lamp switch 200 may shield the stop lamp switch 200 from contact with a foot 500 of the driver.

Figure 7:
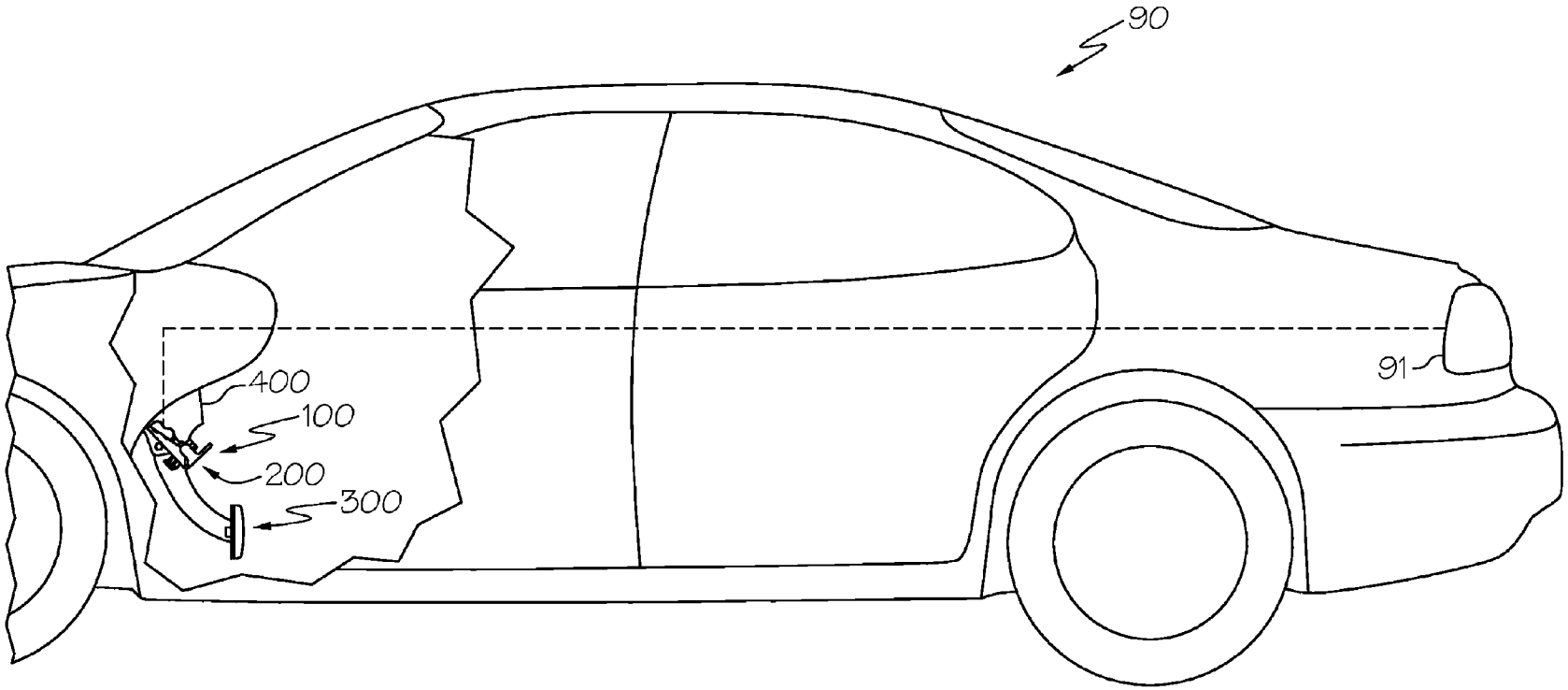
FIG. 7 depicts a schematic view of a motor vehicle that includes a stop lamp switch bracket according to one or more embodiments shown and described herein.

As depicted in FIG. 7, the switch bracket 100 and the brake pedal assembly 300 may be used in conjunction with a motor vehicle 90. The stop lamp switch 200 may be electrically connected with one or more brake lights 91 of the motor vehicle 90. When the brake pedal assembly 300 is depressed, the stop lamp switch 200 is actuated, which causes the brake lights 91 to illuminate. When the brake pedal assembly 300 is returned to its resting position, the brake lights 91 extinguish. Additionally, the stop lamp switch 200 may be electrically connected with other vehicle systems, for example, an engine control unit or a body control unit. Connecting the stop lamp switch 200 with these other components may allow the stop lamp switch 200 to become involved in other motor vehicle 90 operations, such as causing the cruise control to deactivate or causing the brake-shift interlock on motor vehicles 90 with automatic transmissions to unlock, for example.

Returning now to FIG. 6, under normal operation, when a driver depresses the brake pedal 302 with his or her foot 500, the loads applied to the stop lamp switch 200, and therefore to the switch bracket 100, may be small. The loads applied to the switch bracket 100 may be limited to the force required to actuate the stop lamp switch 200. However, because the switch bracket 100 and the stop lamp switch 200 are located in the footspace area of the motor vehicle, the switch bracket 100 may be subject to loads outside of normal operation. Previous switch brackets may not have accommodated these loads outside of normal operation, which may lead to deformation of the switch bracket 100. Failure of the switch bracket 100 may cause the stop lamp switch 200 to become inoperable.

Offsetting the stop lamp switch 200 from the brake pedal 302 may allow for placement of the stop lamp switch 200 in locations with little clearance. This may be beneficial for motor vehicles with little clearance in the passenger footspace area beneath the steering column. However, as depicted in FIG. 6, offsetting a traversing-type stop lamp switch 200 from the brake pedal 302 places the stop lamp switch 200 in the vicinity of the foot 500 of the driver. The switch bracket 100 may provide protection to the stop lamp switch 200 from inadvertent contact with the foot 500 of the driver and/or resist a direct application of force applied by the foot 500 of the driver to the switch bracket 100 itself.

The above-described features of the switch bracket 100 protect the stop lamp switch 200 from inadvertent contact with the foot 500 of the driver. As depicted in FIG. 6, the outer-most portion of the kickplate 106 extends further from the lower surface 104 than the outer-most portion of the stop lamp switch 200. This relationship between the height of the kickplate 106 and the height of the stop lamp switch 200 allows the kickplate 106 to act as a physical barrier to prevent the foot 500 of the driver from contacting the stop lamp switch 200. Thus, the kickplate 106 prevents the foot 500 of the driver from damaging the stop lamp switch 200 or from dislocating the stop lamp switch 200 from the switch mount 103 of the switch bracket 100.

The top surface 108 of the kickplate 106 may control and/or direct the force that a foot 500 of the driver can apply to switch bracket 100. Because the switch bracket 100 is affixed to the brake pedal mount 400 along the attachment zone 109 of the switch bracket 100 (i.e. cantilevered from the brake pedal mount 400), the switch bracket 100 may be prone to twisting about the attachment zone 109/brake pedal mount 400 interface if a foot 500 of the driver inadvertently contacts the switch bracket 100 itself. Because the switch bracket 100 is exposed and positioned within the footspace of the motor vehicle, the switch bracket 100 may bear the entire load applied by the foot 500 of the driver.

The angled top surface 108 of the kickplate 106 may deflect the foot 500 of the driver and prevent it from making complete contact with the switch bracket 100. The angled top surface 108 may assist with sliding a foot 500 of the driver away from the attachment zone 109 when the foot 500 of the driver directly contacts the kickplate 106. Thus, the angled top surface 108 of the kickplate 106 may control the maximum amount of force that is applied to the switch bracket 100 through direct contact with the foot 500 of the driver. Additionally, the angle of the top surface 108 of the kickplate 106 may induce any force that is applied to the kickplate 106 by the foot 500 of the driver to be directed through the gusset bracket 120 into the brake pedal mount 400 such the applied force is supported and resisted by the structural features of the switch bracket 100.

The switch bracket 100 is reinforced against multiple loading conditions that may occur within the footspace area of a motor vehicle. As depicted in FIG. 6, the switch bracket is reinforced against loads applied directly against the top surface 108 of the kickplate 106, as illustrated by arrow $F_1$. In one embodiment, the switch bracket 100 may be capable of resisting a force having a magnitude of about 1120 Newtons applied to the top surface 108 in the direction of arrow $F_1$. In the same embodiment, the switch bracket 100 may be capable of resisting a force having a magnitude of about 280 Newtons applied to the surface of the kickplate 106 in the direction of arrow $F_2$. By resisting these forces, the switch bracket 100 may be capable of overcoming loads that may occur when installed within the footspace of a motor vehicle.

The bracket body 102 and the gusset bracket 120 of the switch bracket 100 may be constructed from a variety of materials, including ferrous and non-ferrous alloys. In one embodiment, the bracket body 102 and the gusset bracket 120 are constructed from a high strength low alloy (HSLA) cold rolled steel with mechanical properties that meet the criteria of SPC440 and/or Japanese Industrial Standard (JIS) SPCF440. Such materials satisfy the requirements for part strength and stiffness while maintaining sufficient workability.

If formed from metal, the bracket body 102 and the gusset bracket 120 may each be formed in a stamping operation or a series of stamping operations. The tab 110 may be welded to the first side flange 112 or the second side flange 114 of the bracket body 102 that the tab 110 overlaps. The gusset bracket 120 may be welded onto the bracket body 102 at locations where the gusset bracket 120 overlaps the lower surface 104 and the first side flange 112 or the second side flange 114. The switch bracket 100 may then be attached to a brake pedal assembly 300. The adjoining components may be spot welded in specific locations as to securely and permanently affix these regions to one another. Alternatively, the adjacent components of the bracket body 102, the gusset bracket 120, and the brake pedal assembly 300 may be coupled to one another using adhesives or fasteners.

In another embodiment, the bracket body 102 and the gusset bracket 120 may be constructed from a reinforced plastic, for example an epoxy reinforced with glass or carbon fiber. The bracket body 102 and the gusset bracket 120 may be molded from the reinforced plastic and secured to one another with adhesives or fasteners.

It should now be understood that switch brackets used in conjunction with pedal assemblies for motor vehicles provide support to stop lamp switches such that when a driver depresses a brake pedal, the stop lamp switch remains in a fixed position, thereby actuating the stop lamp switch. Because switch brackets and stop lamp switches are located in the footspace area of the motor vehicle, the switch brackets and the stop lamp switches may be prone to inadvertent contact with the foot of the driver. Further, the switch brackets and the stop lamp switches may be subjected to high loads associated with a direct application of force by the foot of the driver. Features described hereinabove are directed to managing and/or minimizing these loads as to protect the stop lamp switches from becoming inoperable.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

What is claimed is:

1. A switch bracket comprising:

a bracket body having:

a lower surface, a first side flange extending transverse from the lower surface, a second side flange extending transverse from the lower surface, a kickplate extending transverse from the lower surface and transverse to the first side flange and the second side flange, and a tab extending from the kickplate and attached to the first side flange at a position distal to the kickplate, the kickplate and the first side flange spaced apart from one another at positions between the tab and the lower surface and coupled to one another at positions proximate to the tab, wherein one of the first side flange or the second side flange extends a greater distance from the lower surface than the other and thereby defines an attachment zone of the bracket body about which the switch bracket is mounted; and a switch mount located on the lower surface of the bracket body, wherein the switch mount is configured to retain a stop lamp switch, and at least a portion of the kickplate extends outward from the lower surface further than the stop lamp switch that is retained by the switch mount.

2. The switch bracket of claim 1, wherein the kickplate comprises a top surface that is angled with respect to the lower surface.

3. The switch bracket of claim 1, wherein the kickplate is coupled to one or both of the first side flange and the second side flange.

4. The switch bracket of claim 1, further comprising a gusset bracket that is coupled to the lower surface and one of the first side flange or the second side flange proximate to the attachment zone.

5. The switch bracket of claim 4, wherein the bracket body and the gusset bracket comprise a high strength low alloy cold rolled steel.

6. The switch bracket of claim 1, wherein the kickplate further comprises a bead that extends along at least a portion of the kickplate in a direction approximately perpendicular to the lower surface of the bracket body and spaced between the first side flange and the second side flange, the bead increasing a section modulus of the kickplate.

7. The switch bracket of claim 1, wherein the switch bracket is adapted to be supported by the first side flange or the second side flange that includes the attachment zone and unsupported by the opposite of the first side flange or the second side flange such that the switch bracket is cantilevered from the attachment zone.

8. The switch bracket of claim 1, wherein at least a portion of the kickplate extends outward from the lower surface in a direction of stop lamp switch actuation further than the stop lamp switch retained by the switch mount.

* * * * *